United States Patent [19]

Maurer et al.

[11] Patent Number: 4,670,102

[45] Date of Patent: Jun. 2, 1987

[54] TANDEM CALENDER

[75] Inventors: Hans W. Maurer, Highland; Hiawatha P. Watkins, Columbia, both of Md.

[73] Assignee: Westvaco Corporation, New York, N.Y.

[21] Appl. No.: 817,111

[22] Filed: Jan. 8, 1986

[51] Int. Cl.[4] ..... D21H 5/06; B30B 3/04; D21F 11/00

[52] U.S. Cl. ..... 162/361; 162/205; 162/206; 162/360.1; 100/161; 100/168; 100/169; 100/176

[58] Field of Search ..... 162/205, 206, 360.1, 162/361; 100/38, 93 RP, 161, 168, 169, 170, 176

[56] References Cited

U.S. PATENT DOCUMENTS

| | | | |
|---|---|---|---|
| 56,682 | 7/1866 | Wright . | |
| 745,340 | 12/1903 | Foley . | |
| 4,366,752 | 1/1983 | Koski | 100/162 |
| 4,375,188 | 3/1983 | Leiviska | 100/162 |
| 4,534,829 | 8/1985 | Ahrweiler | 162/361 |

FOREIGN PATENT DOCUMENTS

| | | | |
|---|---|---|---|
| 27621 | 4/1981 | European Pat. Off. | 100/168 |
| 960933 | 6/1964 | United Kingdom | 162/206 |

OTHER PUBLICATIONS

Calkin, "Modern Pulp and Paper Making", 1957, pp. 312–313.

*Primary Examiner*—Peter Chin
*Assistant Examiner*—Thi Dang

[57] ABSTRACT

A tandem calender is provided at the output end of a paper machine which includes two single stack nips in-line. The first nip is formed by a pair of steel rolls which are lightly loaded and the second nip is formed by a steel roll and a plastic covered roll which is loaded 2–10 times greater than the first nip.

4 Claims, 2 Drawing Figures

TANDEM CALENDER

BACKGROUND OF INVENTION

The present invention relates to an on-machine calendering apparatus and its method of use for manufacturing an improved paper substrate for converting and quality printing applications.

The terms "calendering" and "supercalendering" are used herein as ordinarily employed in the paper making art. The term calendering refers to a process in which a web of paper is passed between the nip of a pair of non-resilient rolls, such as rolls made of cast iron or steel, to impart uniform caliper and surface finish to the paper. Typically, a calender will comprise several rolls arranged in a vertical stack with only the bottom roll driven and some means for loading the rolls. Calenders are normally utilized on-machine, i.e., in line with a paper making machine, but may sometimes be used in an off-machine operation. The calendering process produces smoothness and compacts the paper to reduce sheet thickness (caliper) uniformly with some density variations. Supercalendering on the other hand refers to a process in which a web of paper is passed between the nip defined by a non-resilient roll, such as a roll of cast iron or steel, and a resilient or soft roll such as a plastic faced roll or a cotton or paper fiber filled roll. Typically, a supercalender will comprise alternate resilient and non-resilient rolls arranged in a vertical stack, or a non-resilient master roll with two or more resilient rolls positioned at spaced intervals about the periphery of the master roll. Supercalenders are normally utilized off-machine, i.e., supercalendering is usually carried out independently of the paper making process as a separate operation. The supercalendering process produces gloss and also compacts the paper, but to a uniform density with some caliper variations. Thus, the two surface finishing processes, calendering and supercalendering, each make distinct contributions to the final product which are desirable depending upon the ultimate use of the paper. On the other hand, the separate processing of paper off-machine is disadvantageous because of the additional winding and unwinding steps necessary. The ideal arrangement is to have the paper pass through the surface processing steps in a continuous line from the output of the paper making machine.

The integration of supercalenders into the papermaking process on the paper machine has been proposed in the past, but has only recently been undertaken in isolated cases for special purposes. Some examples are disclosed for instance in U.S. Pat. Nos. 4,534,829; 4,375,188; and 4,366,752. The best known example is the MAT-ON-LINE (MOL) calender arrangement fully disclosed in U.S. Pat. No. 4,534,829 referred to above. However, the MOL system even considering its various permutations has not been found to be completely satisfactory for all purposes.

SUMMARY OF PRESENT INVENTION

Paper leaving the dryer section of a paper machine has a rough uneven surface that is not universally suitable for all purposes. Converting grades of paper must meet certain requirements for bulk (caliper) stiffness, gloss and surface smoothness depending upon the desired end use. These requirements are different for example, for envelope paper and for high quality printing paper. Envelope paper requires a certain degree of smoothness for optimum print quality, yet stiffness is needed for envelope production at a high conversion rate. These properties are needed for envelope paper in order to facilitate the transport of such paper through converting equipment such as envelope machines, a non-impact printer, a copy machine, folding, collating and inserting equipment. Most envelope papers are uncoated commodity grades which are surface sized or which have a low coat weight (less than 8 pounds per ream total). It is common practice to pass such paper through a machine calender at the end of the paper machine to achieve the desired surface smoothness for printing. However, machine calendering produces smoothness at the expense of stiffness and leads to other undesirable properties such as caliper loss, loss of opacity and the development of an esthetically undesirable surface gloss mottle. The loss of caliper and stiffness has detrimental effects on the converting rate of envelope machines and on the feeding rate through non-impact printers and other converting equipment. Thus, the production rate of envelope machines has to be reduced when smooth finished, machine calendered paper with a low coefficient of friction is converted, to prevent jam-ups in the equipment. Meanwhile, paper for high quality printing by gravure, flexo or ink jet processes is also supercalendered (in addition to being machine calendered) for increased gloss. The supercalendering step, except for the special examples shown in the prior art, requires expensive off machine capital equipment and labor costs. Furthermore, as a result of such supercalendering, additional caliper and sheet stiffness is lost further impacting any converting operations. Accordingly it may be seen that the prior art processes are not completely satisfactory for all purposes and thus, the process and apparatus disclosed herein fulfills a need for producing a paper substrate suitable for high speed converting and printing with increased paper caliper and stiffness for a given basis weight.

It is therefore, an object of the present invention to provide a process and apparatus for treating the surface of paper in-line on a paper machine to achieve a degree of printability comparable to the results of off-machine supercalendering but with a high degree of conversion rate on typical converting and printing equipment.

Toward this end, it was surprising to find that the combination of one steel/steel nip (first nip) and one soft cover/steel nip (second nip) at the end of a paper machine permitted the production of paper with an improved even sided surface for printing and converting. It was found that the tandem calendering first with a steel/steel nip followed by a nip formed between a plastic covered roll and a steel roll produced a surface suitable for high quality gravure and flexo printing while maintaining higher sheet caliper and stiffness than could be obtained by either machine calendering on the machine or supercalendering off-machine. With the tandem calendering arrangement disclosed herein, it was found that the load at the plastic cover/steel nip could be reduced from previously used levels, since some of the sheet compaction and surface smoothness development was accomplished at the first steel/steel nip. In like manner, the load at the first steel/steel nip could also be reduced because the use of a plastic cover/steel nip in the second position also effectively reduced the gloss mottle which had been generated by high loads at the first steel/steel nip. It was unexpected to find that with the tandem calendering arrangement disclosed, quality printing could be obtained at caliper and Sheffield smoothness levels that were heretofore considered not suitable for quality gravure and flexo printability.

The use of single nip stacks in the present tandem calendering arrangement also reduces the deflection frequency for the plastic covered roll at the second nip to one-half, compared to the inside rolls of a multi-roll off-machine supercalender, thus increasing useful roll life. It was surprising to find that in the tandem arrangement disclosed, only the second single nip stack required a plastic roll. The quality of finish achieved with the tandem arrangement disclosed herein had better side-to-side surface smoothness uniformity (symmetrical finish), and less caliper reduction than using a single steel/steel stack or two single nip plastic cover/steel stacks as disclosed in U.S. Pat. No. 4,534,829. On the other hand, no advantage in surface finish and paper printability was found when using a plastic cover/steel nip stack in the first position of the tandem calender, followed by a conventional steel/steel single nip stack (the reverse of the present invention).

In a preferred version of the present invention, paper taken directly from a paper machine is calendered first with a steel/steel nip at light load which levels gross non-uniformities on the paper surface. Immediately thereafter, the paper is passed through the second nip of the tandem calender comprising a plastic cover/steel nip at a load 2–10 times greater than the first nip which produces surface smoothness on the basis of uniform underlying sheet bulk. The surface of the sheet produced in this manner has an esthetically superior finish with better side-to-side surface smoothness uniformity (symmetrical finish) and lower gloss mottle than can be obtained with steel calendering only in a multi-roll stack. Meanwhile, the plastic cover/steel nip at the second stack requires only about one-half the load that would be needed if no prior steel/steel nip was used.

DETAILED DESCRIPTION

Figure 1:
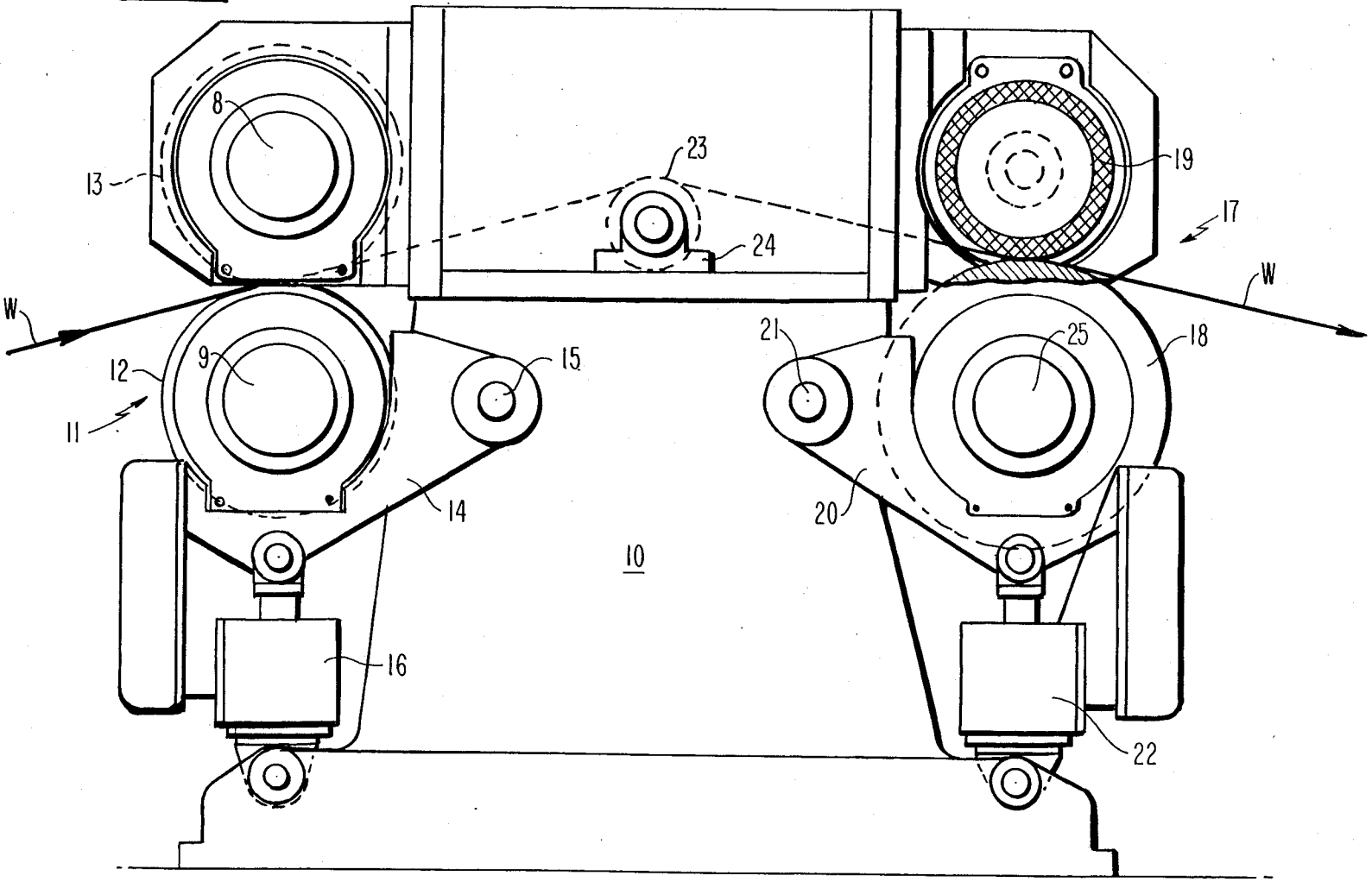
FIG. 1 is a side elevational view of the tandem calender of the present invention; and, FIG. 2 is a side elevation schematic view of a typical paper machine apparatus incorporating the tandem calender device of the present invention.

The present invention will be best understood by referring to the drawing herein and reviewing the examples incorporated to show the surprising results achieved by the apparatus and method claimed.

Referring now to the drawing and more particularly to FIG. 1, the tandem calender apparatus of the present invention may be seen to comprise a frame member 10 on which a pair of spaced single nip calender devices 11 and 17 are mounted. A single frame member 10 is disclosed, however, if desired, the frame could be divided into two separate frame elements where space permits, or other circumstances make desirable the use of a double frame. The first calender device 11 comprises a pair of hard calender rolls 12 and 13 disposed one above the other to form a first roller nip. The surfaces of rolls 12 and 13 are smooth and glossy, being constructed, for example, of chill casting or steel. In the preferred embodiment, the hard calender rolls 12 and 13 are arranged one over the other in a vertical stack so that their respective axes of rotation 8,9 lie substantially in the same vertical plane. However, it may be understood that in certain applications, the calender rolls 12,13 could be laterally offset with respect to one another.

The lower calender roll 12 is rotatably mounted on a movable frame support 14 about a pivot point 15. The frame support 14 is also attached to the frame 10 by the hydraulic cylinder device 16. This arrangement enables the first roller nip to be opened for feeding the web W through the nip of the first calender device 11 and for loading the nip to the desired load for effective calendering. After the web W passes through the first roller nip, it is directed over an idler roller 23 mounted on sub-frame 24 of frame 10 and is directed to the second roller nip formed by second calender device 17.

The second calender device 17 comprises a hard calender roll 18 and a soft calender roll 19 disposed one above the other with the soft calender roll 19 preferably in the top position to form a second roller nip. Hard calender roll 18 has a smooth and glossy surface substantially like calender rolls 12 and 13 in the first calender device, and the soft calender roll preferably is provided with a plastic cover. The design of soft calender roll 19 may be the same for example as the soft rolls disclosed in U.S. Pat. No. 4,534,829. Likewise, as in the case of the first calender device 11, the hard calender roll 18 of second calender device 17 is mounted on a movable frame support 20 for rotation about an axis 25. The frame support 20 is pivotally mounted on frame 10 about a pivot point 21, and also attached to the main frame 10 by a hydraulic cylinder device 22 which is used to open the second roller nip for feeding the web W and for loading the nip as desired.

Figure 2:
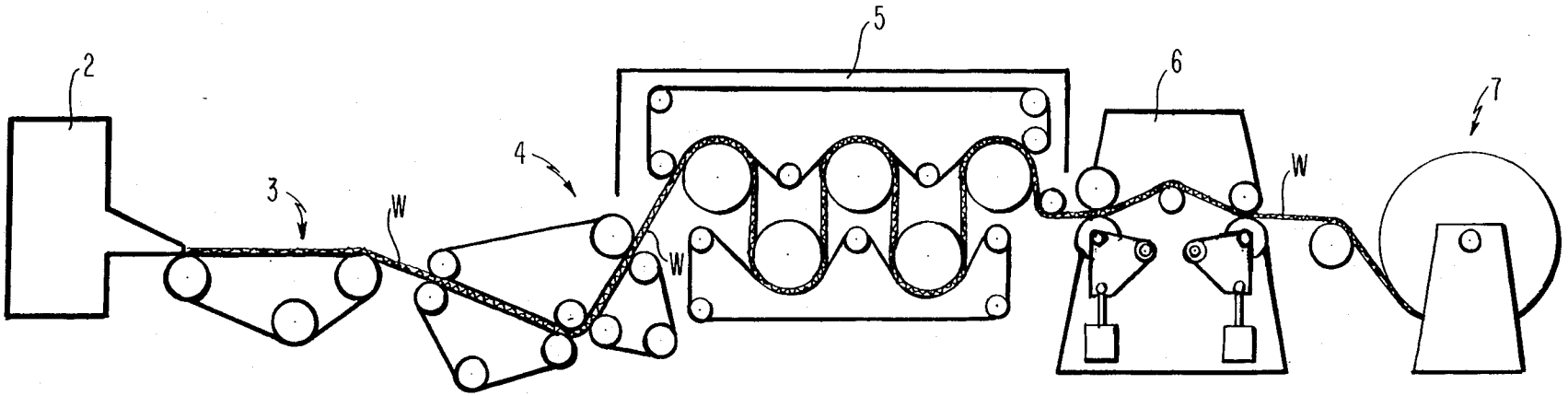

With the tandem calender located at the end of a paper machine as shown in FIG. 2, the calender apparatus functions as an on-machine calender and supercalender, or gloss calender. FIG. 2 illustrates schematically a typical paper machine apparatus incorporating the tandem calender of the present invention. For instance, numeral 2 indicates a head-box which is used to distribute the papermaking slurry onto a wire 3. At the wire 3, the slurry is dewatered to form a wet web W that is conducted to a press section 4 where additional water is removed. From the press section 4, the web W is directed to a drier section 5 where the web is dried. After the drier 5, additional components such as a size press or a coating station (not shown) may be added before passing the web to the tandem calender device 6 more fully disclosed herein. After the tandem calender 6, the web W is passed to the reel section 7 of the paper machine where the finished paper is wound into rolls for shipment or other processing steps.

The results achieved with the arrangement of parts hereinbefore described are illustrated in the following Examples which show consistent and unexpected improvements in paper finishing as compared with the prior art devices.

Paper was calendered with various combinations of plastic covered rolls. The paper was analyzed for visual surface gloss mottle and for printability. Representative results are summarized in the following examples.

EXAMPLE 1

A 50 lb offset paper with surface size (2 lb/Ream) was calendered at 1485 fpm on Pilot equipment. This calendering speed corresponds to 2500 fpm on a commercial paper machine. The paper was evaluated for smoothness, caliper and surface gloss mottle.

| Sample | Calendering: Nip Side to Steel | | Load (pli) | Smoothness: Sheffield F | Sheffield W | Parker F | Parker W | Caliper (Mils) |
|---|---|---|---|---|---|---|---|---|
| 1 | Steel/Steel | — | 248 | 174 | 190 | 5.0 | 5.6 | 4.2 |
| 2 | Plastic/Steel | W | 825 | 201 | 206 | 4.7 | 4.9 | 4.0 |
| 3 | Plastic/Steel | W | 506 | 182 | 209 | 4.2 | 5.0 | 3.9 |
| | Steel/Plastic | F | 825 | | | | | |
| 4 | Steel/Steel | — | 129 | 209 | 219 | 5.0 | 5.5 | 4.1 |
| | Plastic/Steel | W | 413 | | | | | |
| 5 | Steel/Steel | — | 239 | 185 | 188 | 4.5 | 4.9 | 3.9 |
| | Plastic/Steel | W | 825 | | | | | |

F = Felt Side
W = Wire Side

Sample 1 had heavy surface gloss mottle when viewed at a low angle. This gloss mottle correlated with density variations in the sheet. All other samples which had the same poor formation were essentially free of surface gloss mottle.

Sample 2 was calendered with a single plastic cover/steel nip. Use of a plastic roll cover made it necessary to increase the loading pressure due to the wider contact area. The sheet was evensided in smoothness and free of surface gloss mottle.

Sample 3 was obtained by calendering with two plastic cover/steel nips in tandem. The paper was asymmetric in surface smoothness due to the different smoothness development potential of the two-sided fourdrinier sheet.

Sample 4 was calendered first with a steel/steel nip, followed by a plastic cover/steel nip. For both nips, a low loading pressure was used. The paper obtained a Parker smoothness and caliper similar to the result of single steel/steel nip calendering (Sample 1), but the paper surface remained free of mottle.

Sample 5 was obtained by operating the steel/steel nip at the load used for Sample 1 and a subsequent plastic cover/steel at the load used for Sample 2. The calendered paper was more evensided than Sample 3 and had the best balance of properties within the group. A mottle introduced with the hard first nip was effectively removed by the soft second nip.

EXAMPLE 2

Paper applied with a size press coating (7 lb/Ream) was calendered with two plastic cover/steel nips or a combination of one steel/steel nip and a subsequent plastic cover/steel nip. On calendering with a single steel/steel nip, the paper developed a strong surface gloss mottle. The pilot calender was operated at 1485 fpm corresponding to a papermaking speed of 2500 fpm. The paper was evaluated for smoothness, caliper and surface gloss mottle.

| Sample | Calendering: Nip Side to Steel | | Load (pli) | Smoothness: Sheffield F | Sheffield W | Parker F | Parker W | Caliper (Mils) |
|---|---|---|---|---|---|---|---|---|
| A. Offset Formulation | | | | | | | | |
| 1 | Steel/Steel | — | 248 | 153 | 161 | 4.5 | 4.8 | 4.1 |
| | Plastic/Steel | W | 963 | | | | | |
| 2 | Steel/Plastic | F | 413 | 158 | 186 | 4.6 | 5.3 | 4.4 |
| | Plastic/Steel | W | 825 | | | | | |
| B. Rotogravure Formulation | | | | | | | | |
| 3 | Steel/Steel | — | 165 | 165 | 175 | 4.5 | 4.9 | 4.2 |
| | Plastic/Steel | W | 825 | | | | | |
| 4 | Steel/Plastic | F | 413 | 163 | 186 | 4.6 | 5.1 | 4.3 |
| | Plastic/Steel | W | 825 | | | | | |

F = Felt Side
W = Wire Side

All samples were free of surface gloss mottle. The tandem calendering process (Samples 1 and 3) produced a smoother and more even-sided sheet than the use of two plastic cover/steel nips (Samples 2 and 4). Surface gloss mottle introduced with the first (hard) nip was effectively removed in the second (soft) nip. The use of only one plastic cover roll proved to be a strong advantage over the use of two plastic cover rolls.

EXAMPLE 3

Size press coated paper (8 lb/Ream) was tandem calendered or calendered with two plastic cover/steel nips. The paper was printed on a commercial offset press.

| Sample | Calendering: Nip Side to Steel | | Load (pli) | Felt Side Properties: Smoothness Sheffield | Smoothness Parker | Printed Ink Gloss | Printed Ink Density | Opacity |
|---|---|---|---|---|---|---|---|---|
| 1 | Steel/Plastic | | 1000 | 133.3 | 3.8 | 1.21 | .91 | 90.5 |
| | Plastic/Steel | W | 1000 | | | | | |
| 2 | Steel/Steel | — | 120 | 150.6 | 4.3 | 1.18 | .92 | 90.8 |
| | Plastic/Steel | W | 850 | | | | | |

The tandem calendered paper had a printed gloss and ink density similar to the sample which was processed through two plastic cover/steel nips. The paper was free of surface gloss mottle and was ranked equivalent in print quality with the control although it was slightly rougher. Tandem calendering demonstrated substantial technical and cost advantages over calendering with two plastic cover/steel nips. Calendering the paper with only one steel/steel nip produced a commercially unacceptable product.

EXAMPLE 4

A 75 lb offset grade with Vellum finish (never calendered) was calendered on pilot equipment at a simulated paper machine production speed of 2500 fpm.

| Run | Nip | Calender | Load (pli) | Smoothness Felt | Smoothness Wire | Stiffness CD |
|---|---|---|---|---|---|---|
| A | 1 | Plastic Cover/Steel | 399 | 146 | 177 | 155 |
| | 2 | Steel/Plastic Cover | 853 | | | |
| B | 1 | Steel/Steel | 193 | 147 | 156 | 171 |
| | 2 | Plastic Cover/Steel | 935 | | | |

CD = Cross Direction

EXAMPLE 5

A 50 lb obbset grade with Vellum finish was calendered on pilot equipment at a simulated paper machine production speed of 2500 fpm.

| Run | Nip | Calender | Load (pli) | Smoothness Felt | Smoothness Wire | Stiffness CD | Stiffness MD |
|---|---|---|---|---|---|---|---|
| A | 1 | Plastic Cover/Steel | 825 | 201 | 206 | 61 | 130 |
| B | 1 | Plastic Cover/Steel | 506 | 182 | 209 | 62 | 141 |
| | 2 | Steel/Plastic Cover | 825 | | | | |
| C | 1 | Steel/Steel | 239 | 192 | 204 | 71 | 183 |
| | 2 | Plastic Cover/Steel | 413 | | | | |

CD = Cross Direction
MD = Machine Direction

EXAMPLE 6

A 61 lb VH Envelope Grade with a Vellum finish was calendered on pilot equipment at 160° F. and a simulated paper machine speed of 2500 fpm.

| Run | Nip | Calender | Load (pli) | Smoothness Felt | Smoothness Wire | Stiffness MD | Stiffness CD |
|---|---|---|---|---|---|---|---|
| A | 1 | Steel/Steel | 360 | 174 | 186 | 315 | 173 |
| B | 1 | Steel/Steel | 210 | 169 | 174 | 351 | 195 |
| | 2 | Plastic/Steel | 850 | | | | |

MD = Machine Direction
CD = Cross Direction

In connection with Examples 4–6, the smoothness and stiffness was improved in each case where the plastic cover/steel nip was in the second position. Thus it may be seen that the use of a tandem calender as disclosed herein as part of a paper machine in the papermaking process allows the production of a superior surface finish on a variety of paper grades. This method is particularly useful for calendering of uncoated paper grades with a formation pattern characteristic of high speed papermaking, and for paper having low coat weights which tend to develop a severe surface gloss mottle in conventional steel calendering with a multi-roll stack. In the tandem calender disclosed herein, only one plastic covered roll is used, and it is located in the second nip position preferably at the top. The first single nip stack is equipped with two steel rolls and is lightly loaded. Use of only one plastic covered roll in the second nip provides a substantial economic advantage for the papermaking process and the arrangement disclosed eliminates the need for subsequent off-machine supercalendering.

What is claimed is:

1. A tandem calender for in-line employment on a paper machine comprising:

(a) a paper machine;

(b) a first single nip calender device consisting only of a first pair of hard metal rollers to form a first roller nip, said rollers being mounted on a frame independent of the paper machine along the paper travel path exiting from the output of the paper machine;

(c) means for adjusting the position of one of the rolls of said first calender device for opening and loading the first roller nip;

(d) a second single nip calender device independent of said first calender device and consisting only of a hard metal roller and a soft roller arranged adjacent to one another to form a second roller nip, said rollers of said second calender device being mounted on a frame independent of the paper machine and closely spaced from said first calender device along the paper travel path exiting from the output of the paper machine so that the paper exiting said paper machine may be passed substantially straight through said first calender device and then said second calender device without wrapping the rollers of either calender device; and (e) means for adjusting the position of one of the rolls of said second calender device for opening and loading the second roller nip.

2. The apparatus of claim 1 wherein the soft roll in the second roller nip comprises a plastic covered roll and is located above the hard roller.

3. The apparatus of claim 2 wherein said means for adjusting one roll of said second calender device further comprises means for loading the second roller nip 2–10 times greater than the first roller nip.

4. The apparatus of claim 3 wherein said means for adjusting one roll of said second calender device further comprises means for loading the second roller nip in the range of from about 100–200 pounds per linear inch and said means for adjusting one roll of said second calender device further comprises means for loading the second roller nip in the range of from about 400–1000 pounds per linear inch.

* * * * *